US005400712A

United States Patent [19]

Herbage et al.

[11] Patent Number: 5,400,712

[45] Date of Patent: Mar. 28, 1995

[54] DECOY FLARE

[75] Inventors: David W. Herbage; William H. Heinsohn, both of Jackson, Tenn.

[73] Assignee: Alliant Techsystems Inc., Hopkins, Minn.

[21] Appl. No.: 56,134

[22] Filed: Apr. 30, 1993

[51] Int. Cl.[6] ..... F42B 4/04

[52] U.S. Cl. ..... 102/361; 102/336; 102/343; 102/385

[58] Field of Search ..... 102/361, 336, 343, 347, 102/348, 385

[56] References Cited

U.S. PATENT DOCUMENTS

| | | | |
|---|---|---|---|
| 2,666,387 | 1/1954 | Richey | 102/2 |
| 2,671,398 | 3/1954 | Peck | 102/2 |
| 3,015,269 | 1/1962 | Potts | 102/3 |
| 3,223,034 | 12/1965 | Robertson | 102/50 |
| 3,414,218 | 12/1968 | Russnak | 244/138 |
| 3,727,861 | 4/1973 | Swann | 102/4 |

*Primary Examiner*—Donald P. Walsh
*Assistant Examiner*—Fredrick H. Voss
*Attorney, Agent, or Firm*—Hugh D. Jaeger

[57] ABSTRACT

Infrared decoy flare having box fins which deploy upon firing of the flare from an aircraft to stabilize flare trajectory and flight path, and an aerodynamic nose to also enhance flight stability, as well as plume formation and subsequent decoying.

21 Claims, 4 Drawing Sheets

DECOY FLARE

BACKGROUND OF THE INVENTION

1. Field of the Invention—The present invention pertains to the field of pyrotechnics, and more particularly, pertains to an infrared decoy flare used to protect jet fighter aircraft, or any other type of aircraft, from other planes, hostile missiles and the like having guidance systems that target the infrared energy from the aircraft's jet engines, or any other type of engines. The trajectory, and subsequent decoying, by the flare is enhanced over those of the previous art.

2. Description of the Prior Art—The prior art infrared flare devices offered very poor stability subsequent to infrared flare launching, and consisted of generally inadequate areodynamically shaped component members. Poor trajectory of the infrared flare caused concern in decoying capability, as the decaying trajectory of a launched infrared flare generally proved to be of a short distance and of questionable azimuthal stability.

The present invention enhances the performance of existing infrared decoy flares by enhancement of the aerodynamic characteristics and decoying capabilities.

SUMMARY OF THE INVENTION

The general purpose of the present invention is an infrared decoy flare. Described herein is an infrared decoy flare similar to that of the existing MJU-10/B, but having incorporated aerodynamic enhancements. Upon launching and ejection, a set of collapsed fins deploy from the infrared flare grain to impart aerodynamic stability to the launched infrared flare grain, thus improving trajectory, flight path and distancing from the mother aircraft.

The fin stabilized decoy flare is intended to be dispensed from an AN/ALE-45 Countermeasures Dispenser or equivalent using the same mechanism (BBU-36/B Impulse Cartridge) as the current MJU-10/B Decoy Flare.

Upon initiation of the BBU-36/B impulse cartridge, the internal payload begins to move from the case. Hot particles from the BBU-36/B travel through a hole in the piston and ignites a pyrotechnic pellet in the pyrotechnic sequencer on the aft section of the flare.

As the flare and sequencer assembly departs the flare case, the interrupt is removed from between the pyrotechnic pellet and flare grain allowing a flame to ignite the flare. To this point, the functional sequence is identical to the standard MJU-10/B Decoy Flare.

The fin stabilized MJU-10/B flare has stabilizing fins attached to the aft section of the grain. The fins consist of two formed beryllium copper, or other types of materials, box fins attached to the flare grain with binding screws or similar fasteners. Alternatively, comparable flat, stainless steel spring stock material can be substituted. Once the flare assembly is free from the case, the fins are deployed via stored energy (spring force) within the fin itself, orienting the flare nose forward in the windstream. As the flare burns, the fins burn off and fall away. After the flare has been totally consumed, the metal nose and fins will remain.

The integration of the fin and the deployment mechanism, namely an integral spring, is unique. This approach was driven by the available event time window for useful fin deployment. Fin deployment must occur very rapidly in order to orient the flare nose forward prior to flare initiation. This immediate orientation into the oncoming windstream prior to initiation insures a beneficial, uniform, reliable trajectory. After initiation of the flare grain, the effect of the fins on the flight path is minimal. Stability of the flight after initiation is provided by the mass of the nose (mass stabilization), and the drag of the flare plume.

In addition, the nose is more than simply a mass used for mass stabilization. Its uniquely designed pyramid shape generates a beneficial turbulent flow region aft of the nose at the flare grain. The included angle of the pyramid can be optimized for various applications, such as various grain sizes, to achieve the same effect. The turbulent flow region around the flare grain, produced by this geometry, allows enhanced blooming or growth of the plume for an enhanced infrared signal. The included angle of the pyramid shaped nose in this application has been optimized, and proven during flight testing as discussed below.

Testing has been conducted including preliminary dynamic launches utilizing inert flare grains. The inert grains were adjusted to be a mass/moment match with the live grain. Launches were conducted at a 60 degree elevation. With an exist velocity of 99.5 ft/sec, the inert, fin stabilized flare grain traveled 166 feet down range. The flight was stable with no yaw, pitch or roll. The trajectory was uniform and straight. The impact was consistent with the as launched 60 degree elevation. In addition, dynamic live firings were conducted from an F-15 aircraft at both Holloman Airforce Base in New Mexico, and Eglin Airforce Base in Florida. Launches were conducted at various altitudes and airspeeds. Aerodynamic enhancements were realized throughout dynamic testing.

According to one embodiment of the present invention, there is provided an infrared decoy flare having box fins which are secured to the flare grain assembly. The box fins are of spring quality material which forcibly deploy to enhance the flight characteristics of the infrared decoy flare after ejection from its case.

According to another embodiment of the present invention, there is provided an infrared decoy flare having an aerodynamic nose which is secured to the flare grain assembly. The nose is of stainless steel material which provides mass stabilization to enhance the flight characteristics of the infrared decoy flare after ejection from its case and initiation.

One significant aspect and feature of the present invention is an infrared decoy flare having enhanced flight stability, trajectory, and decoying.

Another significant aspect and feature of the present invention is an infrared decoy flare having near instantly deployable box fins.

Other significant aspects and features of the present invention include an infrared decoy flare possessing mass stabilization after initiation and enhanced plume formation due to the pyramid shaped nose.

Having thus described one embodiment of the present invention, it is the principal object hereof to provide an infrared decoy flare having deployable fins for enhancement of flare flight characteristics.

Another embodiment of the present invention is to provide an infrared decoy flare having mass stabilizing nose for enhancement of flare flight characteristics, and enhanced plume formation for improved decoying.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
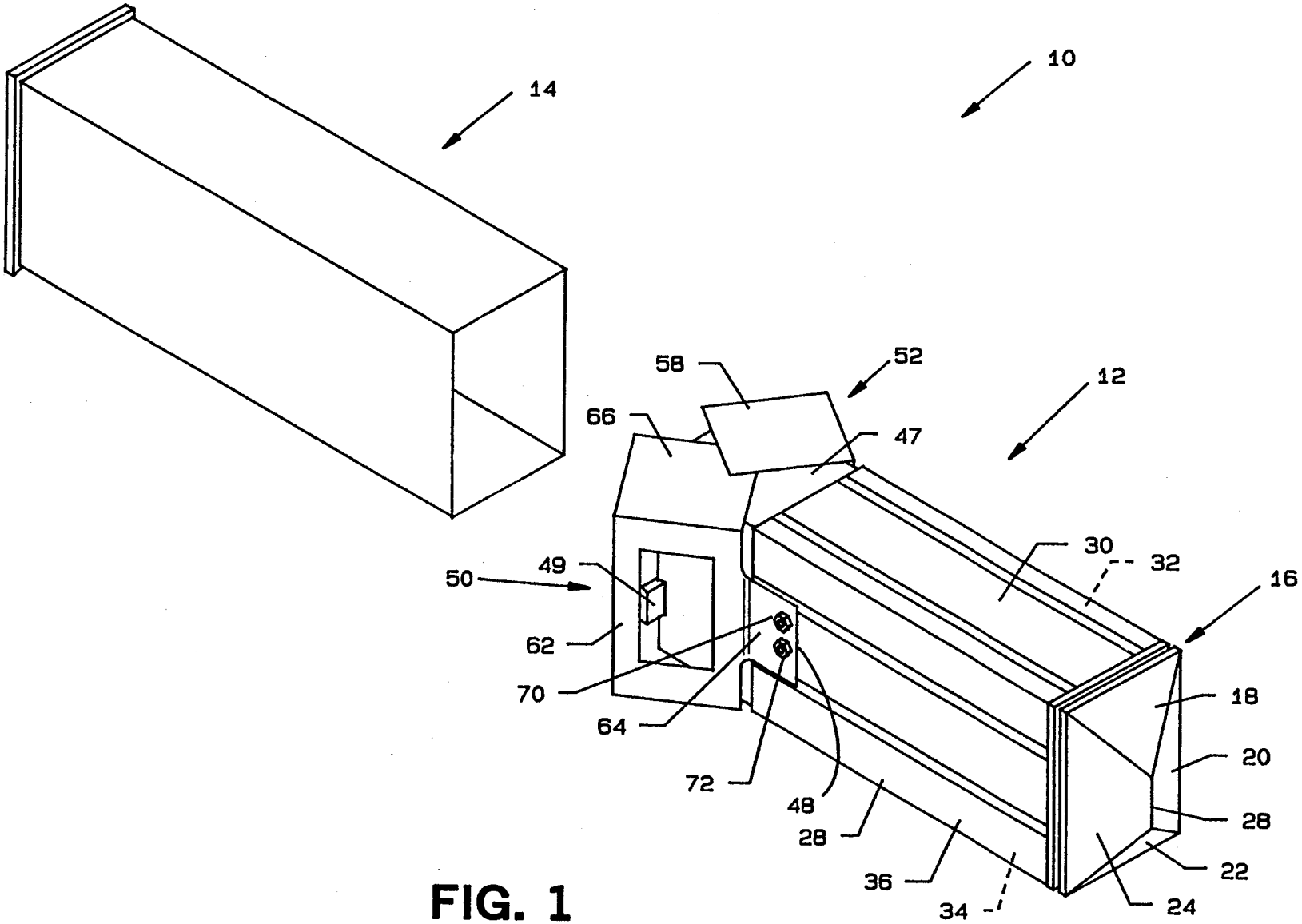
FIG. 1 illustrates a perspective view of a flare decoy, the present invention.
Figure 3:
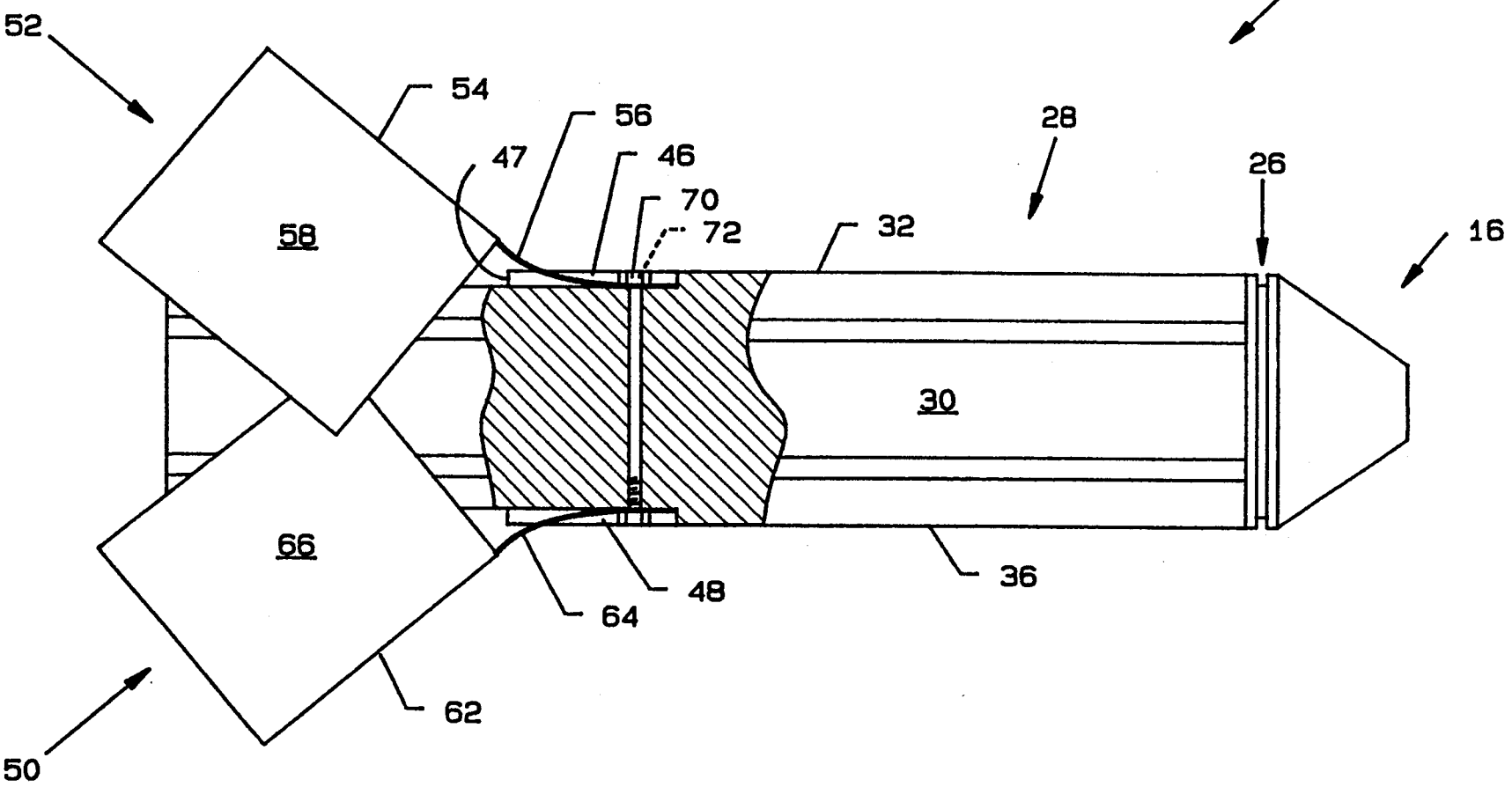
FIG. 3 illustrates a top view in partial cross section of a flare grain assembly with the box fins deployed; and, FIG. 4 illustrates a top view in cross section of the case containing a flare grain assembly.

FIG. 1 illustrates a perspective view of a decoy flare 10 including a flare grain assembly 12 and a case 14, which conforms in shape with and fits over and about the flare grain assembly 12. The flare grain assembly 12 includes a pyramidal like flare nose 16 having angled sides 18, 20, 22 and 24 extending from a staking base 26, to which the case is staked, and meeting at a linear apex 28. The flare nose 16 secures to one end of the flare grain 28. The flare grain 28 is essentially a rectangular solid having sides 30, 32, 34 and 36, each having one or more grooves aligned longitudinally along the side surfaces to aid in grain ignition. Side 30 opposes a like and corresponding side 34 and side 28 opposes a like and corresponding side 32. Sides 28 and 32 have like and corresponding wide recesses 46 and 48 on their surfaces for mounting box fins 50 and 52 as illustrated in FIG. 3. A recess 47 at the rear of the flare grain 28 is common to sides 30, 32, 34 and 36 to accommodate stowed box fins 50 and 52 when the flare grain assembly 12 is loaded into the case 14. A box fin 50 and a box fin 52 secure to the aft portion of the flare grain 28 in the wide recesses 48 and 46, respectively. The box fins 50 and 52, illustrated in deployed position, are built of a suitable material having spring like qualities, such as beryllium copper or other spring grade material and are suitably attached to the flare grain 28 using binding screws or other such devices which may pass through the flare grain as illustrated in FIG. 3. A sequencer assembly 49 is located and secured to the flare grain 28, shown beneath the box fin 50.

Figure 2:
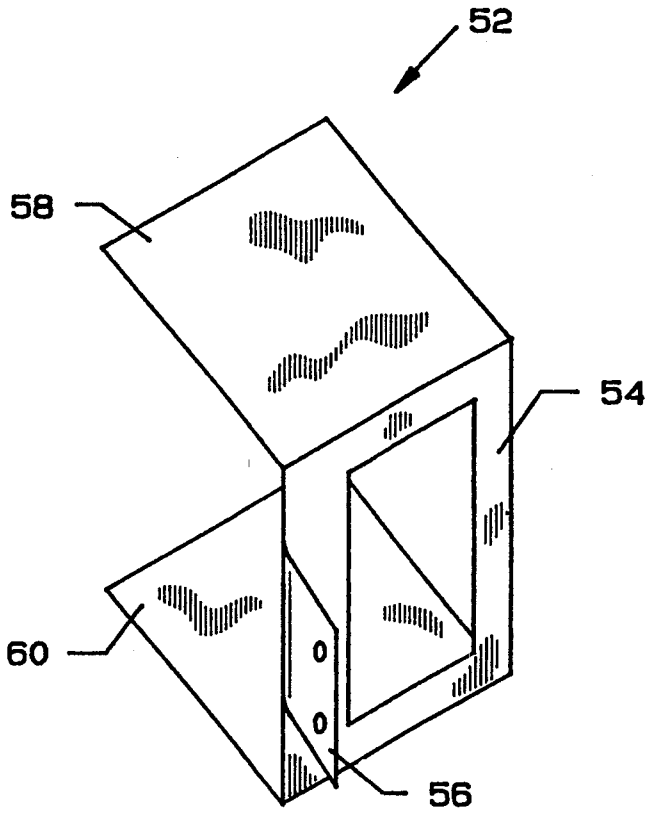
FIG. 2 illustrates a perspective view of a box fin.

FIG. 2 illustrates a perspective view of a box fin 52 including a apertured rectangular planar member 54 from which a holed spring tab 56, a upper rectangular planar member 58 and a lower rectangular planar member 60 extend. The upper and lower rectangular planar members 58 and 60 extend at right angles from the apertured planar member 54, and the holed spring tab 56 extends at approximately 140° from the apertured planar member, allowing for approximately 40° of deployment, thus causing the remaining members of the box fin 52 to be positioned into the windstream. The box fin 50 is constructed in a similar fashion, and of slightly less vertical dimension allowing the rectangular planar members of the box fin 52 to align over and about the corresponding members of the box fin 50 when the flare grain assembly is resident to the case 14 of FIG. 1. The box fin 52 includes similar corresponding ports, including an apertured planar member 62, a holed spring tab 64, and upper and lower rectangular planar members 66 and 68, and are not illustrated in this figure for purposes of brevity and clarity in the illustration.

MODE OF OPERATION

FIG. 3 illustrates a top view in partial cross section of the flare grain assembly 12 with the box fins 50 and 52 deployed. Fastener assemblies 70 and 72, such as a nut and bolt or other suitable fastening device, passes through the holed spring tabs 56 and 64 of the box fins 50 and 52, as well as through the flare grain 28 to fasten the box fins 50 and 52 into the wide recess areas 48 and 46, respectively.

Figure 4:
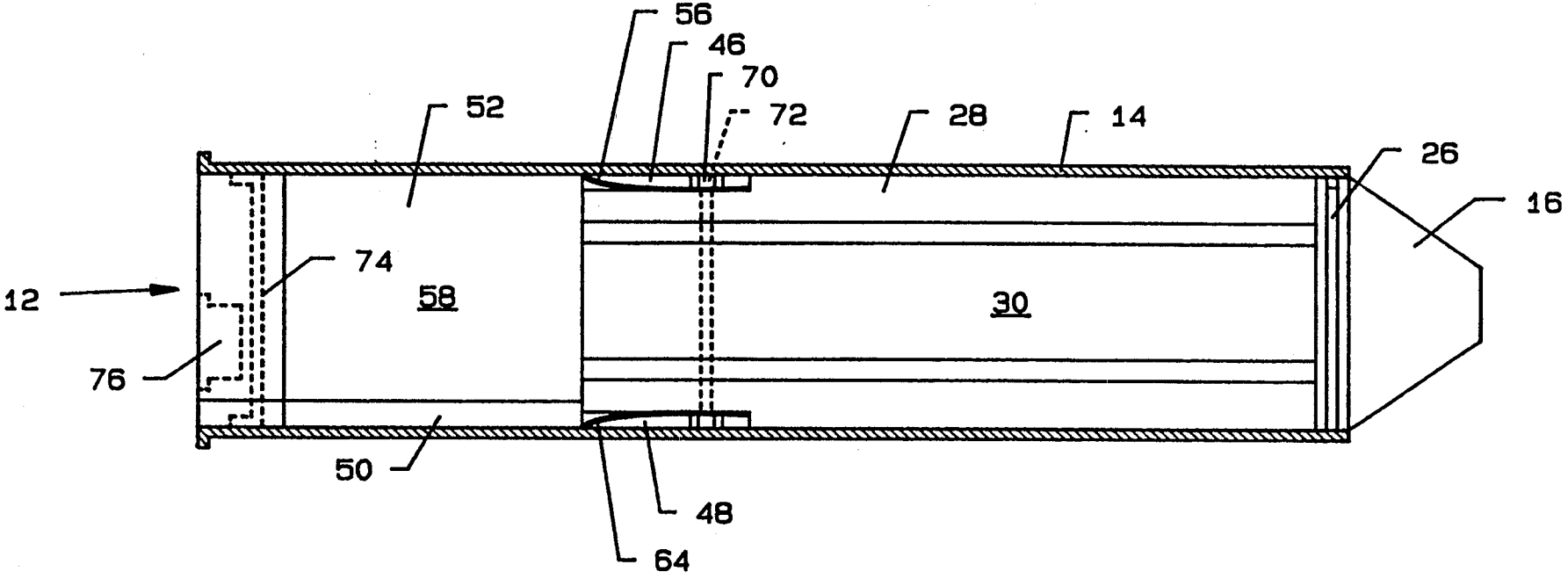

FIG. 4 illustrates a top view in cross section of the case 14 having a flare grain assembly 12 contained therein where all numerals correspond to those elements previously described. The box fins 50 and 52 are held in the stowed position by the sides of the casing 14 prior to deployment as illustrated in FIG. 3. A piston 74 and an impulse cartridge 76 are also depicted in dashed lines in the illustration.

Various modifications can be made the present invention without departing from the apparent scope hereof.

We claim:

1. A decoy flare comprising:

a. a flare grain assembly means;

b. a pyramid shaped nose on said assembly means; and, c. opposing box fin means including holed spring tabs on either side of said assembly means.

2. An infrared decoy flare comprising:

a. flare grain means;

b. an aerodynamic nose means on said flare grain means; and, opposing box fin means on said flare grain means of a spring quality material, whereby said box fin means forcibly deploy on ejection for enhancing flight characteristics of the infrared decoy flare.

3. The flare of claim 2 including a sequencer means on said flare grain means and adjacent one of said box fin means.

4. The flare of claim 2 wherein said box fin means includes:

a. an apertured planar member;

b. a holed spring tab attached to said member; and, c. opposing rectangular planar members extending from ends of said apertured planar member.

5. The flare of claim 4 wherein said box fin means are attached to said flare grain means with screws.

6. The flare of claim 4 wherein said box fin means are of beryllium copper.

7. The flare of claim 4 wherein said box fin means are of stainless steel spring stock.

8. The flare of claim 2 including a case means surrounding said flare grain means and said box fin means.

9. The flare of claim 2 wherein said nose means includes four angled sides between a staking base and a flare grain.

10. An infrared decoy flare comprising:

a. a flare grain means;

b. an aerodynamic nose means on said flare grain means; and, c. stainless steel opposing box fin means on said flare grain means of a spring quality material whereby said box fin means forcibly deploy on ejection for enhancing flight characteristics of the infrared decoy flare.

11. The flare of claim 10 including a sequencer means on said flare grain means and adjacent one of said box fin means.

12. The flare of claim 10 wherein said box fin means includes:

a. an apertured planar member;

b. a holed spring tab attached to said member; and, c. opposing rectangular planar members extending from ends of said apertured planar member.

13. The flare of claim 12 wherein said box fin means are attached to said flare grain means with screws.

14. The flare of claim 10 including a case means surrounding said flare grain means and said box fin means.

15. The flare of claim 10 wherein said nose means includes four angled sides between a staking base and a flare grain.

16. An infrared decoy flare comprising:

a. a flare grain means;

b. an aerodynamic nose means on said flare grain means; and, c. beryllium copper opposing box fin means on said flare grain means of a spring quality material, whereby said box fin means forcibly deploy on ejection for enhancing flight characteristics of the infrared decoy flare.

17. The flare of claim 16 including a sequencer means on said flare grain means and adjacent one of said box fin means.

18. The flare of claim 16 wherein said box fin means includes:

a. an apertured planar member;

b. a holed spring tab attached to said member; and, c. opposing rectangular planar members extending from ends of said apertured planar member.

19. The flare of claim 18 wherein said box fin means are attached to said flare grain means with screws.

20. The flare of claim 16 including a case means surrounding said flare grain means and said box fin means.

21. The flare of claim 16 wherein said nose means includes four angled sides between a staking base and a flare grain.

* * * * *